US006601672B2

(12) United States Patent
Liu

(10) Patent No.: US 6,601,672 B2
(45) Date of Patent: Aug. 5, 2003

(54) DOUBLE LAYER ACOUSTIC LINER AND A FLUID PRESSURIZING DEVICE AND METHOD UTILIZING SAME

(75) Inventor: Zheji Liu, Olean, NY (US)

(73) Assignee: Dresser-Rand Company, Olean, NY (US)

( * ) Notice: Subject to any disclaimer, the term of this patent is extended or adjusted under 35 U.S.C. 154(b) by 0 days.

(21) Appl. No.: 09/929,193

(22) Filed: Aug. 14, 2001

(65) Prior Publication Data

US 2002/0079159 A1 Jun. 27, 2002

Related U.S. Application Data

(63) Continuation of application No. 09/745,862, filed on Dec. 21, 2000.

(51) Int. Cl.[7] ..... E04B 2/02

(52) U.S. Cl. ..... 181/290; 181/286; 181/292; 181/293; 181/213

(58) Field of Search ..... 181/284, 286, 181/290, 292, 293, 295, 213, 214, 217; 428/119

(56) References Cited

U.S. PATENT DOCUMENTS

| | | | | |
|---|---|---|---|---|
| 1,783,276 | A | | 12/1930 | Bliss |
| 1,972,563 | A | | 9/1934 | Irvin |
| 3,181,646 | A | | 5/1965 | Edwards |
| 3,360,193 | A | | 12/1967 | Harris et al. |
| 3,948,346 | A | | 4/1976 | Schindler |
| 4,135,603 | A | | 1/1979 | Dean, III et al. |
| 4,137,992 | A | * | 2/1979 | Herman ..... 181/213 |
| 4,150,850 | A | | 4/1979 | Doerfling |
| 4,189,027 | A | | 2/1980 | Dean, III et al. |
| 4,190,131 | A | | 2/1980 | Robinson |
| 4,204,586 | A | | 5/1980 | Hani et al. |
| 4,241,806 | A | | 12/1980 | Metzger |
| 4,287,962 | A | | 9/1981 | Ingard et al. |
| 4,303,144 | A | | 12/1981 | Wirt |
| 4,421,455 | A | | 12/1983 | Tomren |
| 4,433,751 | A | | 2/1984 | Bonneau |
| 4,504,188 | A | | 3/1985 | Traver et al. |
| 4,848,514 | A | | 7/1989 | Snyder |
| 4,854,416 | A | | 8/1989 | Lalikos et al. |
| 4,926,963 | A | | 5/1990 | Snyder |
| 4,932,835 | A | | 6/1990 | Sorokes |
| 4,944,362 | A | | 7/1990 | Motsinger et al. |
| 4,947,958 | A | | 8/1990 | Snyder |
| 5,007,499 | A | | 4/1991 | Ebbing et al. |
| 5,014,815 | A | | 5/1991 | Arcas et al. |
| 5,025,888 | A | | 6/1991 | Arcas et al. |
| 5,099,566 | A | | 3/1992 | Barrett |
| 5,173,020 | A | | 12/1992 | Ebbing et al. |
| 5,173,021 | A | | 12/1992 | Grainger et al. |
| 5,249,919 | A | | 10/1993 | Sishtla et al. |
| 5,644,918 | A | | 7/1997 | Gulati et al. |
| 5,919,029 | A | | 7/1999 | Van Nostrand et al. |
| 5,923,003 | A | | 7/1999 | Arcas et al. |
| 5,979,593 | A | * | 11/1999 | Rice et al. |
| 6,135,238 | A | | 10/2000 | Arcas et al. |
| 6,309,176 | B1 | * | 10/2001 | Periyathamby et al. ..... 415/119 |

OTHER PUBLICATIONS

International Searching Authority, Patent Cooperation Treaty, Notification of Transmittal of The International Search Report or the Declaration, International Application No. PCT/US01/47515, Apr. 18, 2002, 6 pages.

* cited by examiner

*Primary Examiner*—Khanh Dang
(74) *Attorney, Agent, or Firm*—Haynes and Boone, LLP.

(57) ABSTRACT

This invention relates to a double layer acoustic liner for attenuating noise and consisting of a plurality of cells formed in a plate in a manner to form an array of resonators, and a fluid processing device and method incorporating same.

24 Claims, 2 Drawing Sheets

DOUBLE LAYER ACOUSTIC LINER AND A FLUID PRESSURIZING DEVICE AND METHOD UTILIZING SAME

CROSS REFERENCE TO RELATED APPLICATION

This application is a continuing application of co-pending parent application Ser. No. 09/745,862 filed on Dec. 21, 2000.

BACKGROUND

This invention relates to an acoustic liner of two layers and a fluid pressurizing device and method utilizing same.

Fluid pressurizing devices, such as centrifugal compressors, are widely used in different industries for a variety of applications involving the compression, or pressurization, of a gas. However, a typical compressor produces a relatively high noise level which is an obvious nuisance to the people in the vicinity of the device. This noise can also cause vibrations and structural failures.

For example, the dominant noise source in a centrifugal compressor is typically generated at the locations of the impeller exit and the diffuser inlet, due to the high velocity of the fluid passing through these regions. The noise level becomes higher when discharge vanes are installed in the diffuser to improve pressure recovery, due to the aerodynamic interaction between the impeller and the diffuser vanes.

Various external noise control measures such as enclosures and wrappings have been used to reduce the relative high noise levels generated by compressors, and similar devices. These external noise reduction techniques can be relatively expensive especially when they are often offered as an add-on product after the device is manufactured.

Also, internal devices, usually in the form of acoustic liners, have been developed which are placed in the compressors, or similar devices, for controlling noise inside the gas flow paths. These liners are often based on the well-known Helmholtz resonator principle according to which the liners dissipate the acoustic energy when the sound waves oscillate through perforations in the liners, and reflect the acoustic energy upstream due to the local impedance mismatch caused by the liner. Examples of Helmholtz resonators are disclosed in U.S. Pat. Nos. 4,100,993; 4,135,603; 4,150,732; 4,189,027; 4,443,751; 4,944,362; and 5,624,518.

A typical Helmholtz array acoustic liner is in the form of a three-piece sandwich structure consisting of honeycomb cells sandwiched between a perforated facing sheet and a back plate. Although these three-piece designs have been successfully applied to suppress noise in aircraft engines, it is questionable whether or not they would work in fluid pressurizing devices, such as centrifugal compressors. This is largely due to the possibility of the perforated facing sheet of the liner breaking off its bond with the honeycomb under extreme operating conditions of the compressor, such as, for example, during rapid depressurization caused by an emergency shut down of the compressor. In the event that the perforated facing sheet becomes loose, it not only makes the acoustic liners no longer functional but also causes excessive aerodynamic losses, and even the possibility of mechanical catastrophic failure, caused by the potential collision between the break-away perforated sheet metal and the spinning impeller.

Therefore what is needed is a system and method for reducing the noise in a fluid pressurizing device utilizing a Hemholtz array acoustic liner while eliminating its disadvantages.

SUMMARY

Accordingly an acoustic liner is provided, as well as a fluid processing device and method incorporating same, according to which the liner attenuates noise and consists of one or more acoustic liners each including a plurality of cells formed in a plate in a manner to form an array of resonators.

DETAILED DESCRIPTION

Figure 1:
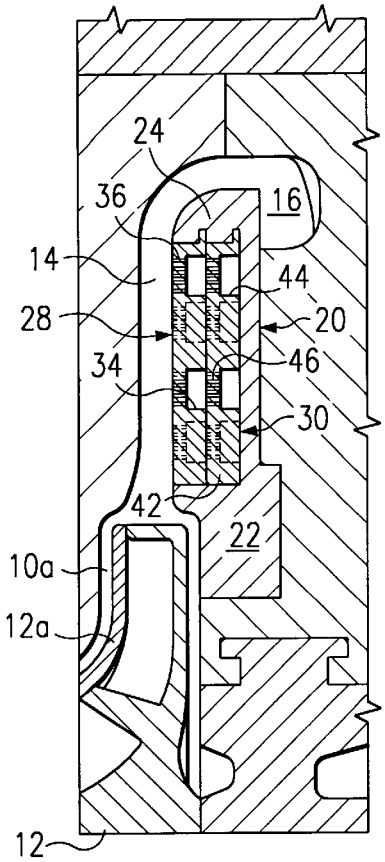
FIG. 1 is a cross-sectional view of a portion of a gas pressurizing device incorporating a pair of acoustic liners according to an embodiment of the present invention.

FIG. 1 depicts a portion of a high pressure fluid pressurizing device, such as a centrifugal compressor, including a casing 10 defining an impeller cavity 10*a* for receiving an impeller 12 which is mounted for rotation in the cavity. It is understood that a power-driven shaft (not shown) rotates the impeller 12 at a high speed, sufficient to impart a velocity pressure to the gas drawn into the compressor via the inlet.

The impeller 12 includes a plurality of impeller blades 12*a* arranged axi-symmetrically around the latter shaft for discharging the gas into a diffuser passage, or channel 14 formed in the casing 10 radially outwardly from the chamber 10*a* and the impeller 12. The channel 14 receives the high pressure fluid from the impeller 12 before it is passed to a volute, or collector, 16. The diffuser channel 14 functions to convert the velocity pressure of the gas into static pressure which is coupled to a discharge volute, or collector 16 also formed in the casing and connected with the channel. Although not shown in FIG. 1, it is understood that the discharge volute 16 couples the compressed gas to an outlet of the compressor.

Due to centrifugal action of the impeller blades 12*a,* gas can be compressed to a relatively high pressure. The compressor is also provided with conventional labyrinth seals, thrust bearings, tilt pad bearings and other apparatus conventional to such compressors. Since this structure is conventional, it will not be shown or described in any further detail.

A mounting bracket 20 is secured to an inner wall of the casing 10 defining the diffuser channel 14 and includes a base 22 disposed adjacent the outer end portion of the impeller and a plate 24 extending from the base and along the latter wall of the casing.

Figure 2:
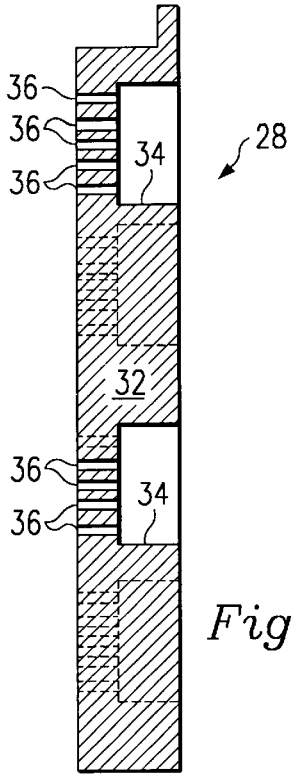
FIG. 2 is an enlarged cross-sectional view of one of the acoustic liners of FIG. 1.

Two one-piece, unitary, annular acoustic liners 28 and 30 are mounted in a groove in the plate 24 of the bracket 20 in a abutting relationship and each is annular in shape and extends around the impeller 12 for 360 degrees. The upper section of the liner 28 is shown in detail in FIGS. 2 and 3, and is formed of an annular, relatively thick, unitary shell, or plate 32 preferably made of steel. The plate 32 is attached to the bracket plate 24 in any conventional manner, such as by a plurality of bolts, or the like.

A series of relatively large cells, or openings, 34 are formed through one surface of the plate 32 and extend through a majority of the thickness of the plate but not through its entire thickness. A series of relatively small cells 36 extend from the bottom of each cell 34 to the opposite surface of the plate 32. Each cell 34 is shown having a disc-like cross section and each cell 36 is in the form of a bore for the purpose of example, it being understood that the shapes of the cells 34 and 36 can vary within the scope of the invention.

According to one embodiment of the present invention, each cell 34 is formed by drilling a relative large-diameter counterbore through one surface of the plate 32, which counterbore extends through a majority of the thickness of the plate but not though the complete thickness of the plate. Each cell 36 is formed by drilling a bore, or passage, through the opposite surface of the plate 32 to the bottom of a corresponding cell 34 and thus connects the cell 34 to the diffuser channel 14.

Figure 3:
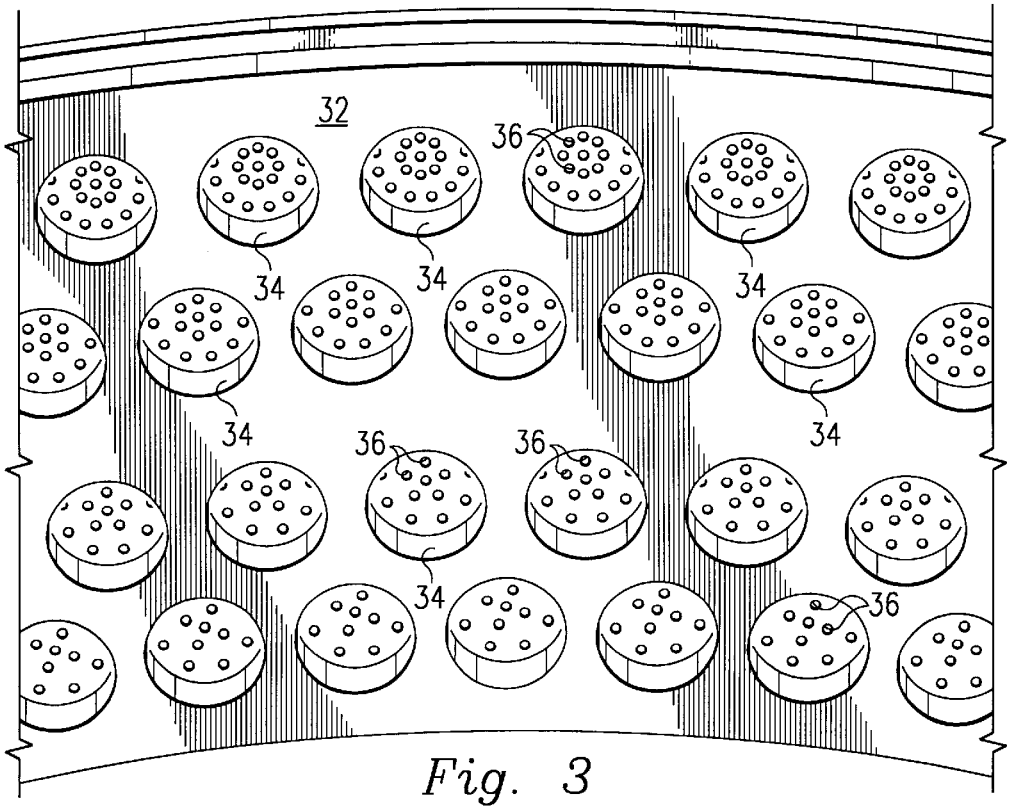
FIG. 3 is an enlarged elevational view of a portion of the liner of FIG. 2.

As shown in FIG. 3, the cells 34 are formed in a plurality of annular extending rows along the entire annular area of the plate 32, with the cells 34 of a particular row being staggered, or offset, from the cells of its adjacent row(s). A plurality of cells 36 are associated with each cell 34 and the cells 36 can be randomly disposed relative to their corresponding cell 34, or, alternately, can be formed in any pattern of uniform distribution.

With reference to FIG. 1, the liner 30 is similar to the liner 28 and, as such, is formed of an annular, relatively thick, unitary shell, or plate 42 (FIG. 1), preferably made of steel, and is attached to the liner 28 in any conventional manner such as by a plurality of bolts, or the like. A series of relatively large cells, or openings, 44 are formed through one surface of the plate 42 and a series of relatively small cells 46 extend from the bottom of each cell 34 to the opposite surface of the plate 32. Since the cells 44 and 46 are similar to the cells 34 and 36, respectively, they will not be described in further detail. Although not shown in the drawings, it is understood that the liners 30 and 28 can be of different thickness.

The liners 28 and 30 are mounted in the bracket plate 24 with the surface of the liner 28 through which the cells 34 extend abutting the surface of the liner 30 through which the cells 46 extend. Also, the cells 34 of the liner 28 are in alignment with the cells 44 of the liner 30. The open ends of the cells 44 of the liner 30 are capped by the underlying wall of the plate 24 of the bracket 20, and the open ends of the cells 34 of the liner 28 are capped by the corresponding surface of the liner 30. The cells 34 of the liner 28 and the cells 44 of the liner 30 are connected by the cells 46 of the liner 30, due to their alignment.

Due to the firm contact between the liners 28 and 30, and between the liner 30 and the corresponding wall of the plate 24 of the bracket 20, and due to the cells 36 and 46 connecting the cells 34 and 44 to the diffuser channel 14, the cells work collectively as an array of acoustic resonators in series. As such, the liners 28 and 30 attenuate the sound waves generated in the casing 10 by the fast-rotation of the impeller 12, and by its associated components, and eliminate, or at least minimize, the possibility that the noise will by-pass the liners and pass through a different path.

Moreover, the dominant noise component commonly occurring at the blade passing frequency, or other high frequency can be effectively lowered by tuning the liners 28 and 30 so that the maximum sound attenuation occurs around the latter frequency. This can be achieved by varying the volume of the cells 34 and 44, and/or the cross-section area, the number, and/or the length of the cells 36 and 46. The provision of the two liners 28 and 30 enables them to attenuate noise in a much wider frequency range than if a single liner were used, thus enabling a maximum amount of attenuation of the acoustic energy generated by the rotating impeller 12 and its associated components to be achieved.

Figure 4:
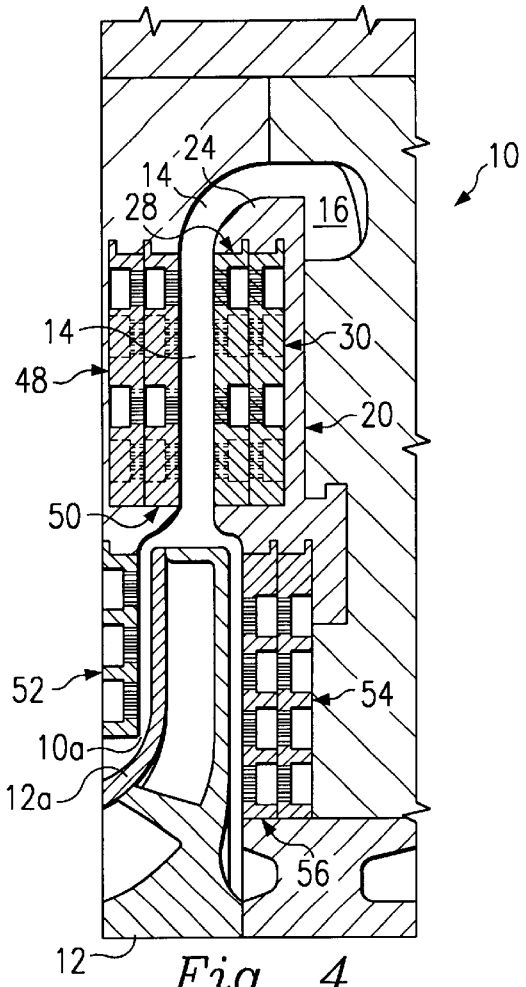
FIGS. 4 and 5 are views similar to that of FIG. 1, but depicting additional acoustic liners disposed at other locations in the fluid pressurizing device.

According to the embodiment of FIG. 4, two one-piece, unitary, annular liners 48 and 50 are secured in a groove formed in the internal wall of the casing 10 opposite to the liners 28 and 30. The liner 48 extends in the bottom of the groove and is connected to the structure forming the groove in any conventional manner, such as by a plurality of bolts, or the like; and the liner 50 extends in the groove in an abutting relationship to the liner 48 and is connected to the liner 48 in any conventional manner, such as by a plurality of bolts, or the like. The liner 50 partially defines, with the liner 30, the diffuser channel 14. Since the liners 48 and 50 are similar to, and functions the same as, the liners 28 and 30, they will not be described in any further detail.

Due to the firm contact between the liners 48 and 50, and between the liner 48 and the corresponding wall of the casing 10, and due to the arrangement of the respective cells of the liners, the cells work collectively as arrays of acoustic resonators in series. As such, the liners 48 and 50 attenuate the sound waves generated in the casing 10 by the fast-rotation of the impeller 12, and by its associated components, and eliminate, or at least minimize, the possibility that the noise will by-pass the liners and pass through a different path.

Moreover, the dominant noise component commonly occurring at the blade passing frequency, or other high frequency can be effectively lowered by tuning the liners 48 and 50 so that the maximum sound attenuation occurs around the latter frequency. This can be achieved by varying the volume and/or the cross-section area, the number, and/or the length of their respective cells. The provision of the two liners 48 and 50 enables them to attentuate noise in a much wider frequency range than if a single liner were used, thus enabling a maximum amount of attenuation of the acoustic energy generated by the rotating impeller 12 and its associated components to be achieved.

Also, two one-piece, unitary, annular liners 54 and 56 are mounted in a groove formed in the casing 10 to the rear of the impeller 12. The liner 54 extends in the bottom of the groove and is connected to the structure forming the groove in any conventional manner, such as by a plurality of bolts, or the like; and the liner 56 extends in the groove in an abutting relationship to the liner 54 and is connected to the liner 54 in any conventional manner, such as by a plurality of bolts, or the like. The liner 56 partially defines, with the liner 52, the chamber in which the impeller 12 rotates.

The liners 54 and 56 have a smaller outer diameter than the liners 28, 30, 48 and 50, but otherwise are similar to, and are mounted in the same manner as, the latter liners.

Due to the firm contact between the liners 54 and 56, and between the liner 54 and the corresponding wall of the casing 10, and due to the arrangement of the respective cells of the liners, the cells work collectively as arrays of acoustic resonators in series. As such, the liners 54 and 56 attenuate the sound waves generated in the casing 10 by the fast-rotation of the impeller 12, and by its associated components, and eliminate, or at least minimize, the possibility that the noise will by-pass the liners and pass through a different path.

Moreover, the dominant noise component commonly occurring at the blade passing frequency, or other high frequency can be effectively lowered by tuning the liners 54 and 56 so that the maximum sound attenuation occurs around the latter frequency. This can be achieved by varying the volume and/or the cross-section area, the number, and/or the length of their respective cells. The provision of the two liners 54 and 56 enables them to attenuate noise in a broader frequency range than if a single liner were used, thus enabling a maximum amount of attenuation of the acoustic energy generated by the rotating impeller 12 and its associated components to be achieved.

Figure 5:
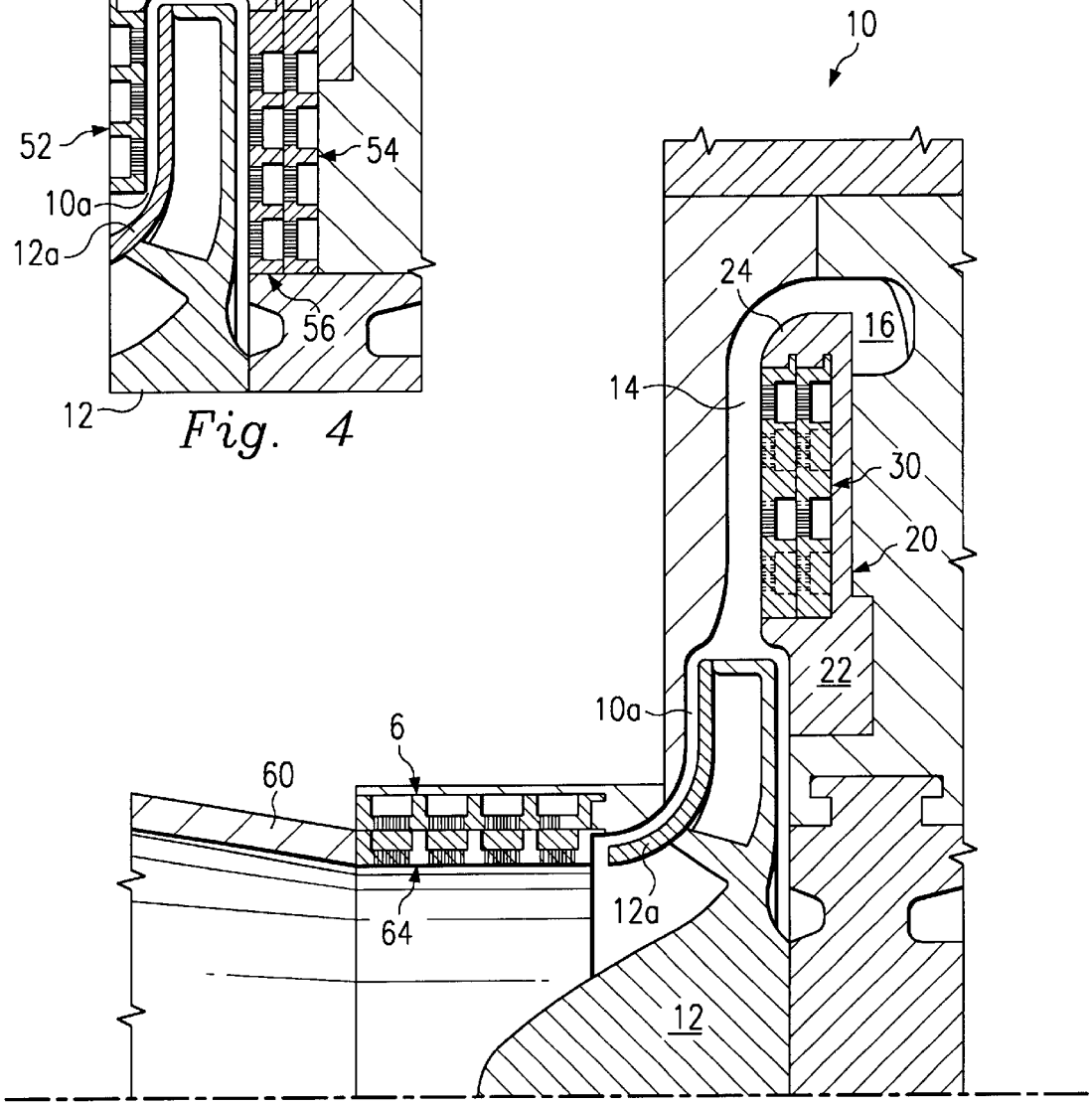

Still another preferred location for liners is shown in FIG. 5 which depicts an inlet conduit 60 that introduces gas to the inlet of the impeller 12. The upper portion of the conduit 60 is shown extending above the centerline C/L of the conduit and the casing 10, as viewed in FIG. 5.

A one-piece, unitary, liner 64 is flush-mounted on the inner wall of the conduit 60 with the radial outer portion being shown. The liner 64 is in the form of a curved shell, preferably cylindrical or conical in shape, is disposed in an annular groove formed in the inner surface of the conduit 60, and is secured in the groove in any known manner. Since the liner 64 is otherwise similar to the liners 28, 30, 48, 50, 52, 54, and 56, it will not be described in further detail.

A one-piece, unitary, liner 66 is also disposed in the latter annular groove and extends around the liner 64 with its inner surface abutting the outer surface of the liner 64. The liner 66 is in the form of a curved shell, preferably cylindrical or conical in shape having a diameter larger than the diameter of the liner 64 and is secured to the liner 64 in any conventional manner, such as by a plurality of bolts, or the like. Since the liners 64 and 66 are otherwise similar to the liners 28, 30, 48, 50, 52, 54, and 56, and function in the same manner to significantly reduce the noise in the casing 10, they will not be described in further detail.

Due to the firm contact between the liners 64 and 66, and between the liner 66 and the corresponding wall of the casing 10 defining the latter groove, and due to the arrangement of the respective cells of the liners, and their location relative the inlet conduit 60, the cells work collectively as arrays of acoustic resonators in series. As such, the liners 64 and 66 attenuate the sound waves generated in the casing 10 by the fast-rotation of the impeller 12, and by its associated components, and eliminate, or at least minimize, the possibility that the noise will by-pass the liners and pass through a different path.

Moreover, the dominant noise component commonly occurring at the blade passing frequency, or other high frequency can be effectively lowered by tuning the liners 64 and 66 so that the maximum sound attenuation occurs around the latter frequency. This can be achieved by varying the volume and/or the cross-section area, the number, and/or the length of their respective cells. The provision of the two liners 64 and 66 enables them to attenuate noise in a broader frequency range than if a single liner were used, thus enabling a maximum amount of attenuation of the acoustic energy generated by the rotating impeller 12 and its associated components to be achieved.

Also, given the fact that the frequency of the dominant noise component in a fluid pressurizing device of the above type varies with the compressor speed, the number of the smaller cells per each larger cell of each liner can be varied spatially across the liners so that the entire liner is effective to attenuate noise in a broader frequency band. Consequently, the liners 28, 30, 48, 50, 52, 54, 56, 64, and 66 can efficiently and effectively attenuate noise, not just in constant speed machines, but also in variable speed compressors, or other fluid pressurizing devices.

In addition to the attenuation of the acoustic energy and the elimination of by-passing of the latter energy, as discussed above, the one-piece unitary construction of the liners in the above embodiments renders the liners mechanically stronger when compared to the composite designs discussed above. Thus, the liners provide a very rigid inner wall to the internal flow in the fluid pressurizing device, and have less or no deformation when subject to mechanical and thermal loading, and thus have no adverse effect on the aerodynamic performance of a fluid pressurizing device, such as a centrifugal compressor, even when they are installed in the narrow passages such as the diffusor channels, or the like.

Variations

The specific arrangement and number of liners in accordance with the above embodiments are not limited to the number shown. Thus, the liners to either side of the diffuser channel and/or the impeller and/or the inlet conduit.

The specific technique of forming the cells in the liners can vary from that discussed above. For example, a one-piece liner can be formed in which the cells are molded in their respective plates.

The relative dimensions, shapes, numbers and the pattern of the cells of each liner can vary.

The liners are not limited to use with a centrifugal compressor, but are equally applicable to other fluid pressurizing devices in which aerodynamic effects are achieved with movable blades.

Each liner can extend for degrees around the axis of the impeller and the inlet conduit as disclosed above; or each liner can be formed into segments which extend an angular distance less than 360 degrees.

The spatial references used above, such as "bottom", "inner", "outer", "side" etc, are for the purpose of illustration only and do not limit the specific orientation or location of the structure.

Since other modifications, changes, and substitutions are intended in the foregoing disclosure, it is appropriate that the appended claims be construed broadly and in a manner consistent with the scope of the invention.

What is claimed is:

1. A fluid pressurizing device comprising:

a casing having an inlet, an outlet, and a plurality of walls defining a chamber between the inlet and the outlet;

an impeller mounted in the chamber and adapted to rotate to flow fluid from the inlet, through the chamber, and to the outlet for discharge from the casing;

a first plate mounted to one of the walls defining the chamber and having a plurality of through openings extending from one surface of the plate to another surface thereof; the one wall capping one end of the openings; and a second plate mounted to the first plate and having a plurality of through openings extending from one surface of the second plate to another surface thereof;

the openings attenuating the acoustic energy generated in the chamber.

2. The device of claim 1 wherein the openings of the second plate extend in alignment with the openings of the first plate.

3. The device of claim 1 wherein the openings in the first plate comprise a plurality of cavities extending from one surface of the first plate which are capped by the one wall; and a plurality of orifices extending from the opposite surface of the plate to each cavity.

4. The device of claim 3 wherein the openings in the second plate comprise a plurality of cavities extending from one surface of the second plate, and a plurality of orifices extending from the opposite surface of the plate to each cavity.

5. The device of claim 4 wherein the cavities of the second plate are aligned with the orifices of the first plate.

6. The device of claim 4 wherein the diameters of the orifices are smaller than the diameters of the cavities.

7. The device of claim 1 wherein the openings are uniformly dispersed in each plate.

8. The device of claim 1 wherein the number and size of the openings of each plate are selected to tune the plates to attenuate the dominant noise component of the acoustic energy.

9. The device of claim 1 wherein one of the surfaces of the first plate abuts the one wall.

10. The device of claim 1 wherein the impeller has a plurality of flow passages in fluid flow communication with the chamber, so that the fluid flows through the passages.

11. The device of claim 1 wherein the chamber includes an area for receiving the impeller and a diffuser channel communicating with the area, wherein the first plate is mounted on a wall defining the diffuser channel; and wherein the fluid flows from the area to the diffuser channel.

12. The device of claim 1 further comprising a third plate mounted to another wall extending opposite the one wall and having a plurality of relatively through openings extending from one surface of the third plate to another surface of the latter plate; the other wall capping one end of the latter openings to further attenuate the acoustic energy generated in the chamber.

13. The device of claim 12 further comprising a fourth plate mounted to the third plate and having a plurality of through openings extending from one surface of the fourth plate to another surface thereof to further attenuate the acoustic energy.

14. The device of claim 13 wherein the openings of the fourth plate extend in alignment with the openings of the third plate.

15. The device of claim 13 wherein the openings in the third and fourth plates include a plurality of cavities extending from one surface of each plate and a plurality of orifices extending from the opposite surface of each plate to each of the latter cavities.

16. The device of claim 15 wherein the cavities of the fourth plate are aligned with the orifices of the third plate.

17. The device of claim 15 wherein the diameters of the orifices of the third and fourth plates are smaller than the diameters of the cavities of the third and fourth plates.

18. The device of claim 1 further comprising a conduit connected to the inlet, and a third plate formed on the inner wall of the conduit and having a plurality of relatively through openings extending from one surface of the latter plate to the other; the inner wall of the conduit capping one end of the openings to form an array of resonators to attenuate the acoustic energy generated in the conduit.

19. The device of claim 18 further comprising a fourth plate mounted to the third plate and having a plurality of through openings extending from one surface of the fourth plate to another surface thereof to further attenuate the acoustic energy generated in the chamber.

20. The device of claim 19 wherein the openings of the fourth plate extend in alignment with the openings of the third plate.

21. The device of claim 19 wherein the openings in the third and fourth plates include a plurality of cavities extending from one surface of each plate and a plurality of orifices extending from the opposite surface of each plate to each of the latter cavities.

22. The device of claim 21 wherein the cavities of the fourth plate are aligned with the orifices of the third plate.

23. The device of claim 21 wherein the diameters of the orifices of the third and fourth plates are smaller than the diameters of the cavities of the third and fourth plates.

24. The device of claim 18 wherein the third and fourth plates are curved to conform to the inner surface of the conduit.

* * * * *